US006292961B1

(12) United States Patent
Ganio et al.

(10) Patent No.: US 6,292,961 B1
(45) Date of Patent: Sep. 25, 2001

(54) SLEEPING BAG DEVICE

(75) Inventors: Theodore Ganio, Pleasant Hill; Erin MacDonald, Emeryville, both of CA (US)

(73) Assignee: Sierra Designs, Inc., Emeryville, CA (US)

( * ) Notice: Subject to any disclaimer, the term of this patent is extended or adjusted under 35 U.S.C. 154(b) by 0 days.

(21) Appl. No.: 09/638,381

(22) Filed: Aug. 12, 2000

(51) Int. Cl.[7] ..... A47G 9/08
(52) U.S. Cl. ..... 5/413 R; 2/69.5
(58) Field of Search ..... 2/69.5; 5/413 R, 5/413 AM, 486

(56) References Cited

U.S. PATENT DOCUMENTS 3,510,889 * 5/1970 Peterson ..... 5/413 R
3,965,505 * 6/1976 Thorowgood ..... 5/413 R
4,888,828 * 12/1989 Tatsuno ..... 5/413 R
5,473,779 * 12/1995 Kramer ..... 5/413 R
5,887,299 * 3/1999 Phillips ..... 5/413 R
5,960,492 * 10/1999 Byrne ..... 5/413 R

* cited by examiner

*Primary Examiner*—Michael F. Trettel
(74) *Attorney, Agent, or Firm*—Malcolm B. Wittenberg

(57) ABSTRACT

A sleeping bag device which includes a warmth retaining body section having a length and width and comprised of insulating material. The body section is sized to accommodate a user's torso and includes a zippered opening running the length of the body section. An insert is provided having a length and width and zippered edges running the length of the insert. The insert can be zippered to the body section to increase the width of the body section noting that the insert is provided with a plurality of elastic elements to compress the width of it.

4 Claims, 2 Drawing Sheets

SLEEPING BAG DEVICE

TECHNICAL FIELD OF INVENTION

The present invention deals with a sleeping bag device as an expedient to expand the internal volume of the sleeping bag device when desired.

BACKGROUND OF THE INVENTION

Sleeping devices are well known and are employed by a wide variety of users. Such devices generally are configured as having an elongated inner volume for accepting and accommodating the torso of a user. Such sleeping bag devices include warmth-retaining sidewalls surrounding an inner volume having a head opening which can also serve as a means to enter and exit the sleeping bag device.

The body section of the sleeping bag device is provided with a warmth-retaining sidewall of heat-insulating material such as goose down, cotton or synthetic insulation which fills a space between inner and outer lining materials. The outer lining material is oftentimes made waterproof as such products are generally designed to enable a user to lie directly upon the ground which, depending upon climactic conditions, can be wet.

Although traditional sleeping bag devices tend to work adequately to insulate a user outdoors while asleep, the sizing of such products has proven to be somewhat of a challenge. Although most sleeping bag devices are of standard length to accommodate the height of an average user, it is the width of the sleeping bag which provides its internal volume that is addressed in the practice of the present invention. Specifically, gaps are formed between a user's body and the sidewalls of the device. As the user lies within the sleeping bag device, it would be ideal to provide the smallest such gap possible in order to maximize warmth-retaining efficiency. For example, U.S. Pat. No. 4,888,828 issued on Dec. 26, 1989, provides for a means of reducing this gap by providing elastic members which compress the body retaining bag in such a manner as to reduce the cross-sectional area of its inner volume thus allowing the bag to closely fit around the user's body.

In light of the above-noted constraints, it has been found necessary to produce and thus inventory sleeping bag devices of varying widths to accommodate not only single users of various sizes but also to accommodate multiple users in a single bag. For example, a husband and wife may wish to share a single bag rather than to employ two bags, side by side. However, such a bag would be inappropriate for a single user for the internal volume of such a device would be so excessive that heat retention would be most inefficient. Similarly, a bag sized to accommodate a large framed man would be inefficient for use by a small framed woman.

It is thus an object of the present invention to provide a sleeping bag device which can be configured to readily and conveniently change its internal volume to appropriately conform to the torso of its user or users.

It is a further object of the present invention to produce a single sleeping bag device whose internal volume can be readily changed in order to reduce the number of such devices in inventory to accommodate the varying needs of its users.

These and further objects will be more readily appreciated when considering the following drawings and appended claims.

SUMMARY OF THE INVENTION

The present invention involves a sleeping bag device characterized as having a warmth-retaining body section having a length and width and comprised of insulating material. The sleeping bag device is sized to accommodate a user's torso having a zippered opening substantially running the length of the body section. An insert is provided having a length and width and zippered edges running the length of the insert such that the insert can be zippered to the body section to increase the width of the body section. The insert is further characterized as having a plurality of elastic elements acting to compress the width thereof.

DETAILED DESCRIPTION OF THE INVENTION

Figure 1:
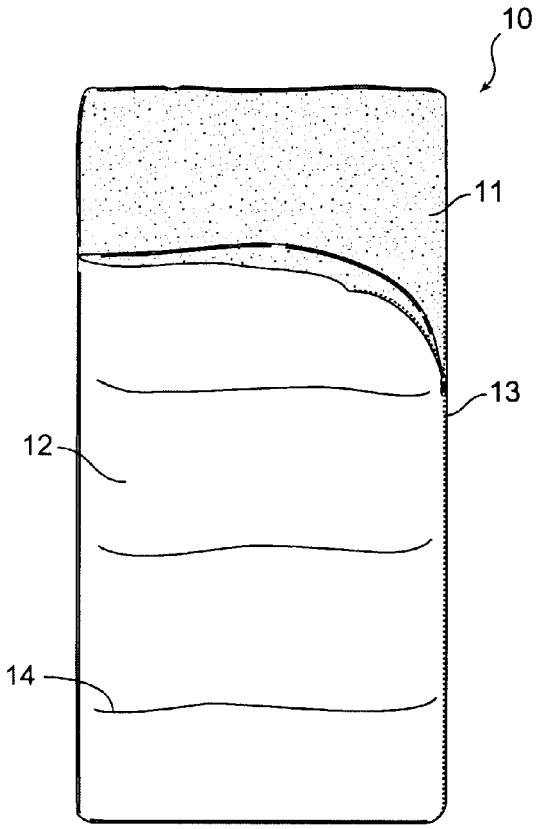
FIG. 1 (PRIOR ART)
FIG. 1 depicts a typical sleeping bag device of the prior art.

FIG. 1 depicts sleeping bag device 10 as typifying such devices currently available. Sleeping bags can have a generally rectangular footprint where open end 11 simply provides a flat pad which can be cushioned or uncushioned to support the head of a user and a body section 12 sized to fit the torso of a user. Alternatively, sleeping bag 10 can be of the "mummy" type whereby open end 11 can be more rounded and elasticized or have a drawstring to more closely capture the head of a user to preserve body heat in order to make the sleeping bag device more thermally efficient.

Sleeping bag 10 can be rated for varying climactic conditions whereby body section 12 can be provided with either natural or synthetic insulation, the nature and content of which are well known in this art. Such devices can also, optionally, be provided with a zipper 13 to facilitate the entrance and egress from sleeping bag device 10. Such devices can further be provided with outer shell fabric which can be water resistant and even waterproof in anticipation that sleeping bag device 10 may, at some point in time, be employed on bare ground which may be wet. Obviously, moisture intrusion within sleeping bag device 10 is something to be avoided.

As noted previously, it is generally recognized that thermal efficiency can be enhanced if the interior volume of sleeping bag device 10 is kept to a minimum. It s the torso of a user of such a device which heats the interior of the sleeping bag and thermal efficiency is enhanced if the volume to be heated by the user tracks his or her size. To facilitate this design goal, oftentimes, elastic elements 14 such as Lycra® strips or elastic bands sewn into the body of the bag are provided to compress the volume of the bag to, again, minimize interior volume.

Figure 2:
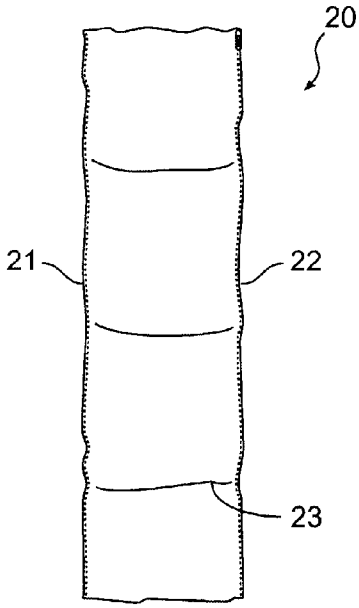
FIG. 2 is directed to an insert of the type for use herein in practicing the present invention.

As noted previously, manufacturers of sleeping bags are faced with somewhat of quandary in trying to produce an inventory of sleeping bags which accommodate users of various sizes and even multiple users while, at the same time, minimizing interior volume for efficiency. Pursuant to the present invention, sleeping bag 10 can be produced of an average size to accommodate a typical user both in terms of length and width creating a somewhat standard interior volume. In practicing the present invention, sleeping bag 10 can be made much more versatile by providing insert 20 as shown in FIG. 2.

Figure 3:
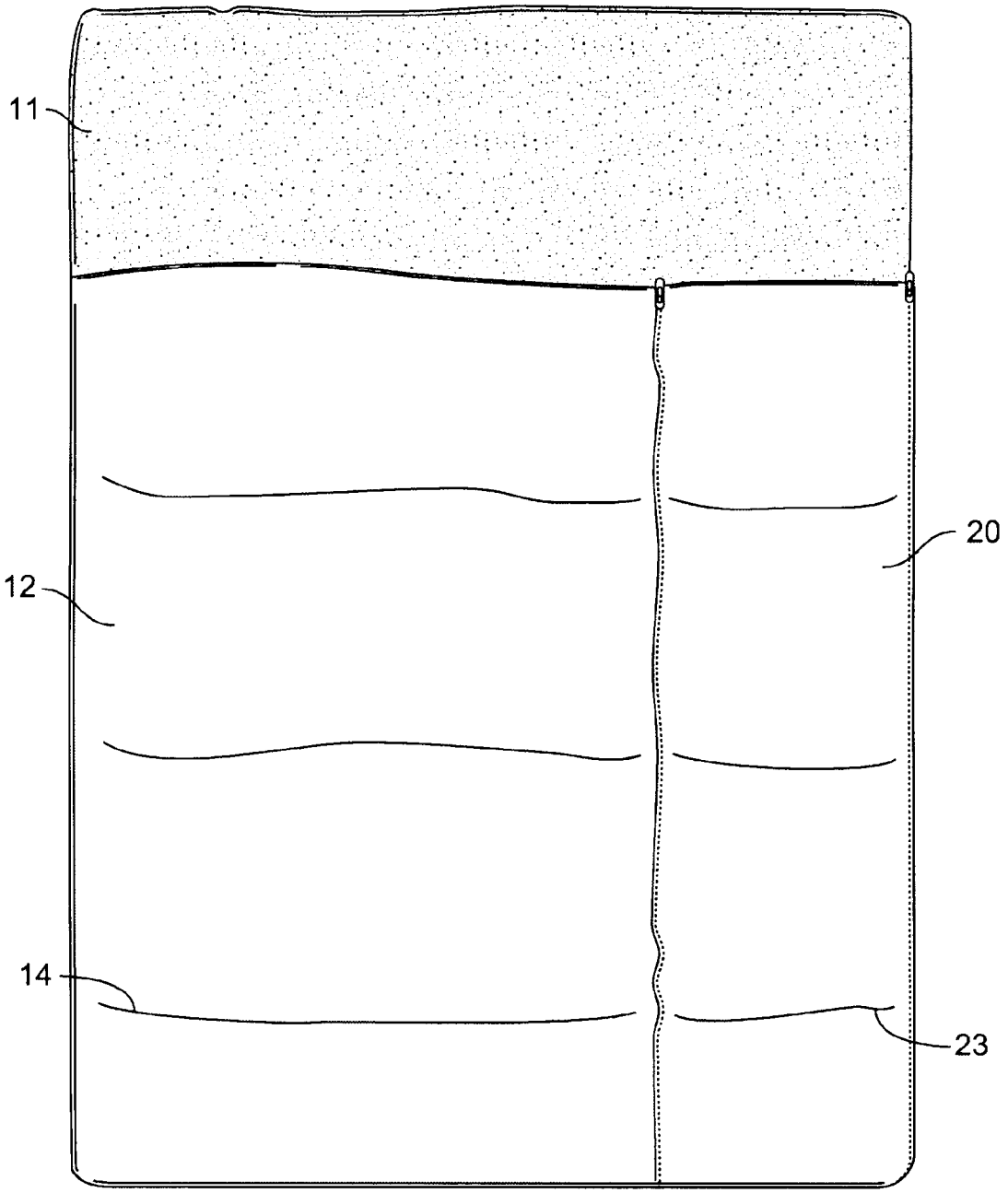
FIG. 3 shows the insert of FIG. 2 configured within the sleeping bag device of FIG. 1.

Insert 20 is intended to be employed with sleeping bag device 10 of the type having zipper 13 running substantially the length of body section 12. In this regard, insert 20 is provided with zippered edges 21 and 22 which are designed to mate with the edges of zipper 13. As such, sleeping bag device 10 perhaps designed for a typical single user can be made to accommodate the torso of an oversized user or even multiple users by simply applying insert 20 to sleeping bag device 10. This combination is shown in FIG. 3. As a further expedient, it is intended that insert 20 be provided with a plurality of elastic elements 23 such as Lycra® strips or elastic bands sewn into the body of the bag which act to compress the width of insert 20. In doing so, sleeping bag device 10, even in its expanded condition as shown in FIG. 3 acts to compress the overall width of sleeping bag 10 to, again, act to maximize thermal efficiency.

In practicing the present invention, it is contemplated that the length of insert 20 be substantially equal to the length of zipper 13. It is further contemplated, as a preferred embodiment, that sleeping bag 10 be provided with its own set of elastic elements 14 which may or may not align with elastic elements 23 of insert 20. If so, it is preferred that these sets of elastic elements be configured to run parallel to one another and substantially perpendicular to zippered edges 21 and 22.

In practicing the present invention, it has now been taught that a manufacturer can produce an inventory of a much smaller number of sleeping bag devices to accommodate users of various sizes and multiple users by simply further providing an insert to expand the versatility of such devices. By providing elastic elements to compress this insert, it can result in an expanded internal volume and yet capture and minimize such volume to enhance thermal efficiency.

What is claimed is:

1. A sleeping bag device comprising in combination:

A. a warmth retaining body section having a length and width and comprised of insulating material sized to accommodate a user's torso and having a zippered opening substantially running the length of said body section; and B. an insert having a length and width and zippered edges running the length of said insert such that said insert can be zippered to said body section to increase the width of said body section, said insert having a plurality of elastic elements acting to compress the width thereof.

2. The sleeping bag of claim 1 wherein the length of said insert is substantially equal to the length of said zippered opening in said body section.

3. The sleeping bag of claim 1 wherein said body section is further provided with a plurality of elastic elements acting to compress the width thereof.

4. The sleeping bag of claim 1 wherein each of said plurality of elastic elements are configured to run parallel to one another and substantially perpendicular to said zippered edges.

* * * * *